US010453437B2

(12) United States Patent
Christoph et al.

(10) Patent No.: US 10,453,437 B2
(45) Date of Patent: Oct. 22, 2019

(54) SOUND REPRODUCTION WITH ACTIVE NOISE CONTROL IN A HELMET

(71) Applicant: HARMAN BECKER AUTOMOTIVE SYSTEMS GMBH, Karlsbad (DE)

(72) Inventors: Markus Christoph, Straubing (DE); Paul Zukowski, Chamerau (DE); Matthias Kronlachner, Regensburg (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 0 days.

(21) Appl. No.: 15/380,190

(22) Filed: Dec. 15, 2016

(65) Prior Publication Data

US 2017/0193981 A1 Jul. 6, 2017

(30) Foreign Application Priority Data

Dec. 16, 2015 (EP) ..... 15200375

(51) Int. Cl.

| | |
|---|---|
| ***G10K 11/178*** | (2006.01) |
| ***H04R 5/033*** | (2006.01) |
| ***H04R 1/10*** | (2006.01) |
| ***H04R 3/00*** | (2006.01) |
| ***H04S 7/00*** | (2006.01) |

(52) U.S. Cl.

CPC ..... *G10K 11/178* (2013.01); *G10K 11/17857* (2018.01); *G10K 11/17875* (2018.01);

(Continued)

(58) Field of Classification Search

CPC ..... G10K 11/1786; G10K 11/1788; G10K 2210/102; G10K 2210/103; G10K 2210/1081; G10K 2210/3026; G10K 2210/3028; G10K 2210/3055; G10K 2210/3219; G10K 2210/3221; G10K 11/178; G10K 11/17857; G10K 11/17875;

(Continued)

(56) References Cited

U.S. PATENT DOCUMENTS 5,127,022 A * 6/1992 Takegahara ..... H03M 7/3044 341/76
5,841,876 A * 11/1998 Gifford ..... F16F 13/26 381/71.14

(Continued)

FOREIGN PATENT DOCUMENTS

EP 2551845 A1 1/2012

OTHER PUBLICATIONS

Extended European Search Report for Application No. 15200375.2, dated Jul. 13, 2016, 8 pages.

*Primary Examiner* — Paul Kim
*Assistant Examiner* — Friedrich Fahnert
(74) *Attorney, Agent, or Firm* — Brooks Kushman P.C.

(57) ABSTRACT

An exemplary sound reproducing, noise reducing method and system include supplying to a corresponding loudspeaker a useful signal that represents sound to be reproduced and an anti-noise signal that, when reproduced by the corresponding loudspeaker, reduces noise in the vicinity of the corresponding microphone. The method and system further include receiving audio input signals and processing the audio input signals to provide the useful signals so that the useful signals provide a more realistic sound impression for a listener wearing the helmet than the audio input signals.

19 Claims, 7 Drawing Sheets

(52) U.S. Cl.
CPC ..... *G10K 11/17885* (2018.01); *H04R 1/1083* (2013.01); *H04R 3/00* (2013.01); *H04R 3/005* (2013.01); *H04R 5/033* (2013.01); *H04S 7/30* (2013.01); *G10K 2210/102* (2013.01); *G10K 2210/103* (2013.01); *G10K 2210/1081* (2013.01); *G10K 2210/3026* (2013.01); *G10K 2210/3028* (2013.01); *G10K 2210/3055* (2013.01); *G10K 2210/3219* (2013.01); *G10K 2210/3221* (2013.01); *H04R 2201/023* (2013.01); *H04R 2460/01* (2013.01); *H04S 2420/01* (2013.01)

(58) Field of Classification Search
CPC ..... G10K 11/17885; H04R 1/1083; H04R 2460/01; H04R 3/00; H04R 3/005; H04R 5/033; H04R 2201/023; H04S 2420/01; H04S 7/30
USPC ..... 381/17, 59, 71.1, 71.6, 71.11, 122, 309; 704/226, 233, E21.002
See application file for complete search history.

(56) References Cited

U.S. PATENT DOCUMENTS 6,683,960 B1* 1/2004 Fujii ..... G10K 11/178 381/71.8
8,320,591 B1 11/2012 Wurtz
2005/0117754 A1* 6/2005 Sakawaki ..... G10K 11/1782 381/71.6
2005/0271214 A1* 12/2005 Kim ..... H04S 1/002 381/17
2006/0116886 A1* 6/2006 Kim ..... G10L 19/008 704/503
2007/0033029 A1* 2/2007 Sakawaki ..... G10K 11/178 704/233
2007/0121956 A1 5/2007 Bai et al.
2009/0175463 A1* 7/2009 Lee ..... H04R 3/005 381/71.6
2010/0020986 A1* 1/2010 Nemer ..... H04R 3/00 381/94.1
2010/0195844 A1* 8/2010 Christoph ..... G10K 11/178 381/71.11
2011/0007907 A1* 1/2011 Park ..... G10K 11/178 381/71.8
2011/0038496 A1 2/2011 Lott et al.
2011/0206214 A1* 8/2011 Christoph ..... G10K 11/1784 381/71.6
2012/0215519 A1 8/2012 Park et al.
2012/0259626 A1 10/2012 Li et al.
2013/0101129 A1* 4/2013 Christoph ..... G10K 11/178 381/71.1
2016/0180830 A1* 6/2016 Lu ..... G10K 11/178 381/71.6
2016/0329061 A1* 11/2016 Heber ..... G10L 19/26
2018/0286373 A1* 10/2018 O'Connell ..... G10K 11/1782

* cited by examiner

SOUND REPRODUCTION WITH ACTIVE NOISE CONTROL IN A HELMET

CROSS-REFERENCE TO RELATED APPLICATIONS

This application claims priority to EP application Serial No. 15200375.2 filed Dec. 16, 2015, the disclosure of which is hereby incorporated in its entirety by reference herein.

TECHNICAL FIELD

The disclosure relates to a system and method (generally referred to as a "system") for sound reproduction and active noise control in a helmet.

BACKGROUND

Unfortunately, a motorcyclist's hearing may be impeded by engine noise, wind noise and helmet design, among other things. High noise levels, such as those experienced by motorcyclists, may render listening to music or speech in a helmet unpleasant or even impossible. Moreover, high intensity noise, which in turn requires high intensity speech and music signals for a satisfying listening experience, may have long-term consequences on a motorcyclist's hearing ability. Noise affecting a motorcyclist may have many sources, such as engine noise, road noise, other vehicle noise and wind noise. As the speed of a motorcycle increases, typically the most prominent source of noise is wind noise. This effect increases dramatically as speed increases. At highway speeds, noise levels may easily exceed 100 dB when wearing a traditional helmet. This is particularly troublesome for daily motorcyclists as well as occupational motorcyclists, such as police officers. To combat the noise, some motorcycle helmets use sound deadening material around the area of the ears. Other motorcyclists may opt to use earplugs to reduce noise and prevent noise induced hearing loss. Another way to reduce noise are built-in active noise cancellation systems which, however, may have a deteriorating effect on the speech or music.

SUMMARY

An exemplary sound reproducing, noise reducing system includes a helmet, two loudspeakers disposed in the helmet at opposing positions, and two microphones disposed at positions in the vicinity of the two loudspeakers. The system further includes two active noise control modules coupled to the two loudspeakers. The active noise control modules are configured to supply to the corresponding loudspeaker a useful signal that represents sound to be reproduced and an anti-noise signal that, when reproduced by the corresponding loudspeaker, reduces noise in the vicinity of the corresponding microphone. The system further includes an audio signal enhancement module connected upstream of the active noise control modules, the audio signal enhancement module being configured to receive audio input signals and to process the audio input signals to provide the useful signals so that the useful signals provide a more realistic sound impression for a listener wearing the helmet than the audio input signals.

An exemplary sound reproducing, noise reducing method includes supplying to a corresponding loudspeaker a useful signal that represents sound to be reproduced and an anti-noise signal that, when reproduced by the corresponding loudspeaker, reduces noise in the vicinity of the corresponding microphone. The method further includes receiving audio input signals and processing the audio input signals to provide the useful signals so that the useful signals provide a more realistic sound impression for a listener wearing the helmet than the audio input signals.

Other systems, methods, features and advantages will be, or will become, apparent to one with skill in the art upon examination of the following figures and detailed description.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

An exemplary helmet may comprise several layers, including a shell, a shock-absorbing layer, and a comfort layer. A helmet's shell is the outermost layer and is typically made from resilient, water-resistant materials such as plastic and fiber composites. A helmet's shock-absorbing layer, which is its primary safety layer, may be made out of a rigid, but shock-absorbing material such as expandable polystyrene foam. Further, this layer may have sound and thermo-insulating qualities and may be alternatively referred to as an acoustic layer. Finally, a helmet's comfort layer may be made of a soft material meant to contact with a motorcyclist's skin, such as cotton or other fabric blends as are known in the art. Other layers may be present as well, and some of the aforementioned layers may be omitted or combined.

Figure 1:
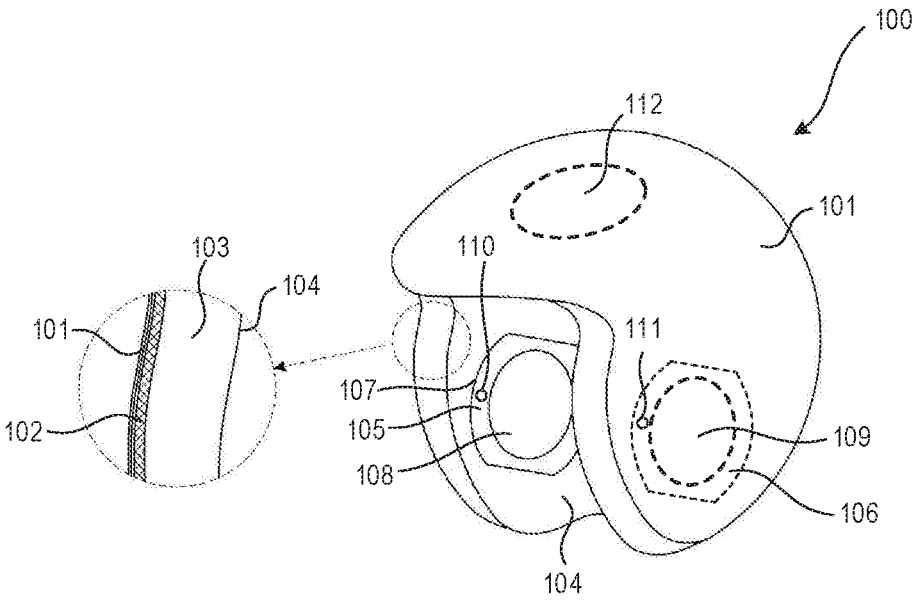
FIG. 1 is a perspective view of a motorcycle helmet with an active noise control system.

FIG. 1 is a perspective view of a motorcycle helmet 100. The helmet 100 comprises an outer shell 101, an acoustic layer 102, a foam layer 103, a comfort layer 104, and an optionally passive noise reduction system (not shown). The helmet 100 further comprises ear-cups 105 and 106 which are mounted on each inner side of the helmet 100 where the ears of a user will be when the helmet 100 is worn by the user. Note that in FIG. 1 only one ear-cup 105 is visible. However, an identical ear-cup 106, shown in broken lines, is also present on the opposite side of the helmet 100.

As is shown in FIG. 1, the ear-cup 105 is (and so is ear-cup 106) isolated from the shell 101 of the helmet 100 by an isolation mount 107. The isolation mount 107 may be made of a vibration dampening material. The vibration dampening material may prevent shell vibrations from reaching a user's ear and thus may decrease the user's perception of those vibrations as noise. Thus, by mounting the ear-cup 105 to something other than the shell 101 of the helmet, and decoupling it from rigid materials that easily transmit vibrations, noise transmitted to the ear-cup 105 may be reduced.

Each ear-cup 105, 106 embraces, for example, a loudspeaker 108, 109 or any other type of sound driver or electro-acoustic transducer or a group of loudspeakers, built into the ear-cup 105, 106. Additionally, the helmet 100 may include acoustic sensors such as microphones 110 and 111 that sense noise and actively reduce or cancel noise in conjunction with loudspeakers 108 and 109 in each ear-cup 105, 106. The microphones 110 and 111 are disposed in the vicinity of the loudspeakers 108 and 109 (e.g., in the ear cups 105 and 106), which means in the present example that they are disposed on the same side of the helmet 100 as the respective loudspeaker 108, 109 since the loudspeakers 108 and 109 are disposed at opposing positions inside the helmet 100. The microphones 110 and 111 may be disposed at the same curved plane inside the helmet 100 as secondary sources such as loudspeakers 108 and 109.

The loudspeakers 108 and 109 and the microphones 110 and 111 are connected to an audio signal processing module 112. The audio signal processing module 112 may be partly or completely mounted within the shell 101 of helmet 100 and may be isolated from the shell 101 by vibration dampening material. Alternatively, the audio signal processing module 112 is partly or completely disposed outside the helmet 100, and the loudspeakers 108, 109 and the microphones 110, 111 are linked via a wired or wireless connection to the audio signal processing module 112. Furthermore, the audio signal processing module 112—regardless of where it is disposed—may be linked via a wired or wireless connection to an audio signal bus system and/or a data bus system (both not shown in FIG. 1).

Figure 2:
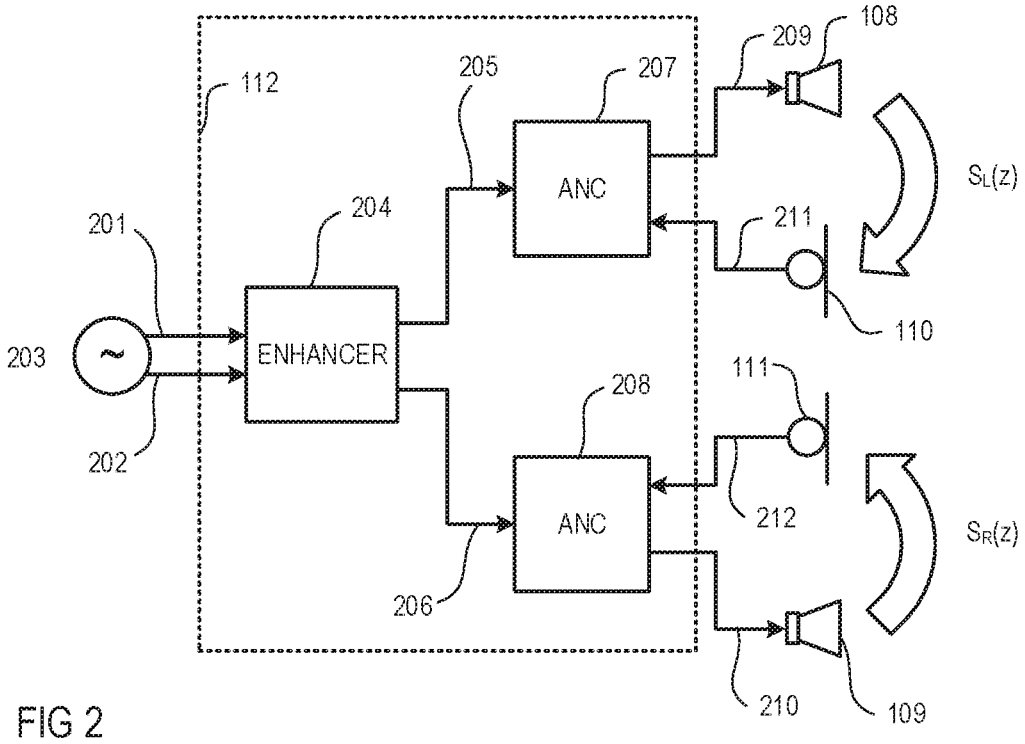
FIG. 2 is a signal flow chart illustrating the signal flow in the helmet shown in FIG. 1.

FIG. 2 shows the audio signal processing module 112 used in the helmet 100 shown in FIG. 1. Microphones 110 and 111 provide to the audio signal processing module 112 electrical signals that represent the sound picked up by the microphones 110 and 111 at their respective positions. The audio signal processing module 112 processes the signals from the microphones 110, 111, and produces signals therefrom that are supplied to the loudspeakers 108 and 109. The audio signal processing module 112 receives (e.g., stereo or other multi-channel) audio signals 201 and 202 (also referred to as useful signals) from an audio signal source 203. The exemplary audio signal processing module 112 may include a two-channel audio enhancement (sub-) module 204 which receives the audio signals 201 and 202 and outputs two enhanced stereo signals 205 and 206. The enhanced stereo signals 205 and 206 are each supplied to an automatic noise control (ANC) (sub-) module 207, 208. ANC (sub-) modules 207 and 208 provide output signals 209 and 210 that drive loudspeakers 108 and 109, and further receive microphone output signals 211 and 212 from microphones 110 and 111.

Figure 3:
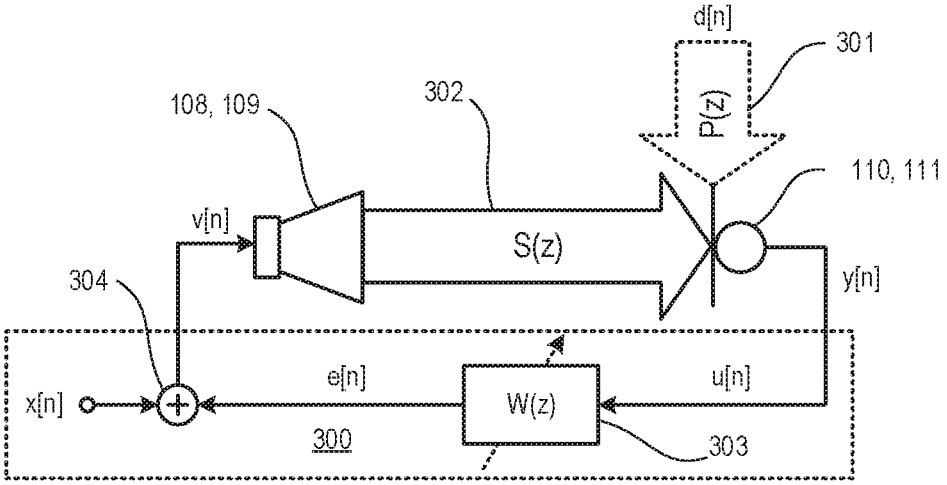
FIG. 3 is a signal flow chart of a general feedback type active noise reduction system in which a useful signal is supplied to the loudspeaker signal path.

Reference is now made to FIG. 3, which is a signal flow chart illustrating a general feedback type ANC module 300 which can be employed as (sub-) modules 207 and 208 in the audio signal processing module 112 shown in FIG. 2. In the ANC module 300, a disturbing signal d[n], also referred to as noise signal, is transferred (radiated) to a listening site, for example, a listener's ear, via a primary path 301. The primary path 301 has a transfer characteristic P(z). Additionally, an input signal v[n] is transferred (radiated) from the loudspeaker 108 or 109 to the listening site via a secondary path 302. The secondary path 302 has a transfer characteristic S(z). The microphone 110 or 111 positioned at or close to the listening site receives together with the primary path filtered disturbing signal d[n] the signals that arise from the loudspeaker 108 or 109, and thus from the loudspeaker driving signal v[n] filtered by the secondary path. The microphone 110 or 111 provides a microphone output signal y[n] (such as microphone output signals 211 and 212 in the audio signal processing module 112 shown in FIG. 2) that represents the sum of these received signals. The microphone output signal y[n] is supplied as filter input signal u[n] to an ANC filter 303 that outputs to an adder 304 an error signal e[n]. The ANC filter 303, which may be an adaptive or non-adaptive filter, has a transfer characteristic of W(z). The adder 304 also receives an optionally pre-filtered, e.g., with a spectrum shaping filter (not shown in the drawings) useful signal x[n] such as music or speech and provides an input signal v[n] to the loudspeaker 108 or 109.

The signals x[n], y[n], e[n], u[n] and v[n] are, for example, in the discrete time domain. For the following considerations their spectral representations X(z), Y(z), E(z), U(z) and V(z) are used. The differential equations describing the system illustrated in FIG. 3 in view of the useful signal are as follows:

$$Y(z)=S(z)\cdot V(z)=S(z)\cdot(E(z)+X(z)) \tag{1}$$

$$E(z)=W(z)\cdot U(z)=W(z)\cdot Y(z) \tag{2}$$

In the system of FIG. 3, the useful signal transfer characteristic M(z)=Y(z)/X(z) is thus $$M(z)=S(z)/(1-W(z)\cdot S(z)) \tag{3}$$

Assuming W(z)=1 then $$lim[S(z)\rightarrow 1]M(z)\Rightarrow M(z)\rightarrow\infty \tag{4}$$

$$lim[S(z)\rightarrow\pm\infty]M(z)\Rightarrow M(z)\rightarrow 1 \tag{5}$$

$$lim[S(z)\rightarrow 0]M(z)\Rightarrow S(z) \tag{6}$$

Assuming W(z)=∞ then $$lim[S(z)\rightarrow 1]M(z)\Rightarrow M(z)\rightarrow 0. \tag{7}$$

As can be seen from equations (4)-(7), the useful signal transfer characteristic M(z) approaches 0 when the transfer characteristic W(z) of the ANC filter 303 increases, while the secondary path transfer function S(z) remains neutral, i.e., at levels around 1, i.e., 0 [dB]. For this reason, the useful signal x[n] has to be adapted accordingly to ensure that the useful signal x[n] is apprehended identically by a listener when ANC is on or off. Furthermore, the useful signal transfer characteristic M(z) also depends on the transfer characteristic S(z) of the secondary path 302 to the effect that the adaption of the useful signal x[n] also depends on the transfer characteristic S(z) and its fluctuations due to aging, temperature, change of listener etc. so that a certain difference between "on" and "off" will be apparent.

Figure 4:
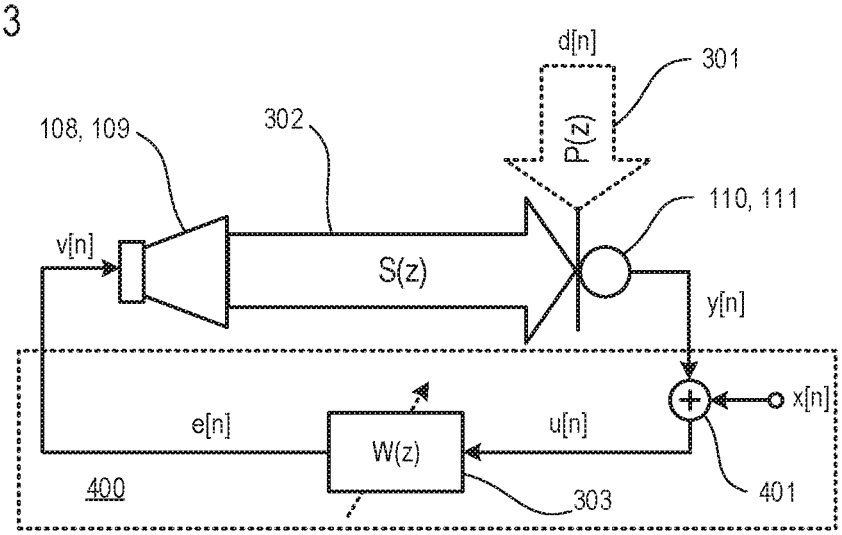
FIG. 4 is a signal flow chart of a general feedback type active noise reduction system in which the useful signal is supplied to the microphone signal path.

While in the ANC module 300 shown in FIG. 3 the useful signal x[n] is supplied to the acoustic sub-system (loudspeaker, room, microphone) at the adder 304 connected upstream of the loudspeaker 108 or 109, in an ANC module 400 shown in FIG. 4 the useful signal x[n] is supplied thereto at the microphone 110 or 111. Therefore, in the ANC module 400 shown in FIG. 4, the adder 304 is omitted (e.g., may be substituted by a direct connection) and an adder 401 is connected downstream of microphone 110 or 111 to sum up the, for example, pre-filtered, useful signal x[n] and the microphone output signal y[n]. Accordingly, the loudspeaker input signal v[n] is the error signal [e], i.e., v[n]=[e], and the filter input signal u[n] is the sum of the useful signal x[n] and the microphone output signal y[n], i.e., u[n]=x[n]+y[n].

The differential equations describing the system illustrated in FIG. 4 in view of the useful signal are as follows:

$$Y(z)=S(z)\cdot V(z)=S(z)\cdot E(z) \tag{8}$$

$$E(z)=W(z)\cdot U(z)=W(z)\cdot(X(z)+Y(z)) \tag{9}$$

The useful signal transfer characteristic M(z) in the system of FIG. 4 without considering the disturbing signal d[n] is thus $$M(z)=(W(z)\cdot S(z))/(1-W(z)\cdot S(z)) \tag{10}$$

$$lim[(W(z)\cdot S(z))\rightarrow 1]M(z)\Longrightarrow M(z)\rightarrow\infty \tag{11}$$

$$lim[(W(z)\cdot S(z))\rightarrow 0]M(z)\Longrightarrow M(z)\rightarrow 0 \tag{12}$$

$$lim[(W(z)\cdot S(z))\rightarrow\pm\infty]M(z)\Longrightarrow M(z)\rightarrow 1. \tag{13}$$

As can be seen from equations (11)-(13), the useful signal transfer characteristic M(z) approaches 1 when the open loop transfer characteristic (W(z)·S(z)) increases or decreases and approaches 0 when the open loop transfer characteristic (W(z)·S(z)) approaches 0. For this reason, the useful signal x[n] has to be adapted additionally in higher spectral ranges to ensure that the useful signal x[n] is apprehended identically by a listener when ANC is on or off. Compensation in higher spectral ranges is, however, quite difficult so that a certain difference between "on" and "off" will be apparent. On the other hand, the useful signal transfer characteristic M(z) does not depend on the transfer characteristic S(z) of the secondary path 302 and its fluctuations due to aging, temperature, change of listener etc.

Figure 5:
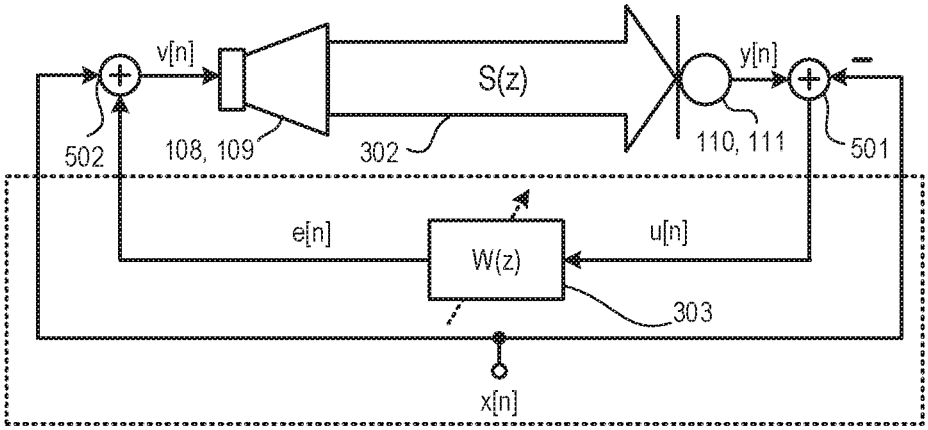
FIG. 5 is a signal flow chart of a general feedback type active noise reduction system in which the useful signal is supplied to the loudspeaker and microphone signal paths.

FIG. 5 is a signal flow chart illustrating a general feedback type active noise reduction system in which the useful signal is supplied to both, the loudspeaker path and the microphone path. For the sake of simplicity, the primary path 301 is omitted below notwithstanding the fact that noise (disturbing signal d[n]) is still present. In particular, the system of FIG. 5 is based on the system of FIG. 3, however, with an additional subtractor 501 that subtracts the useful signal x[n] from the microphone output signal y[n] to form the ANC filter input signal u[n] and with a adder 502 that substitutes adder 304 shown in FIG. 3 and that adds the useful signal x[n] and error signal e[n].

The differential equations describing the system illustrated in FIG. 5 in view of the useful signal are as follows:

$$Y(z)=S(z)\cdot V(z)=S(z)\cdot(E(z)+X(z)) \tag{14}$$

$$E(z)=W(z)\cdot U(z)=W(z)\cdot(Y(z)-X(z)) \tag{15}$$

The useful signal transfer characteristic M(z) in the system of FIG. 5 is thus $$M(z)=(S(z)-W(z)\cdot S(z))/(1-W(z)\cdot S(z)) \tag{16}$$

$$lim[(W(z)\cdot S(z))\rightarrow 1]M(z)\Longrightarrow M(z)\rightarrow\infty \tag{17}$$

$$lim[(W(z)\cdot S(z))\rightarrow 0]M(z)\Longrightarrow M(z)\rightarrow S(z) \tag{18}$$

$$lim[(W(z)\cdot S(z))\rightarrow\pm\infty]M(z)\Longrightarrow M(z)\rightarrow 1. \tag{19}$$

It can be seen from equations (17)-(19) that the behavior of the system of FIG. 5 is similar to that of the system of FIG. 4. The only difference is that the useful signal transfer characteristic M(z) approaches S(z) when the open loop transfer characteristic (W(z)·S(z)) approaches 0. Like the system of FIG. 3, the system of FIG. 5 depends on the transfer characteristic S(z) of the secondary path 302 and its fluctuations due to aging, temperature, change of listener etc.

Figure 6:
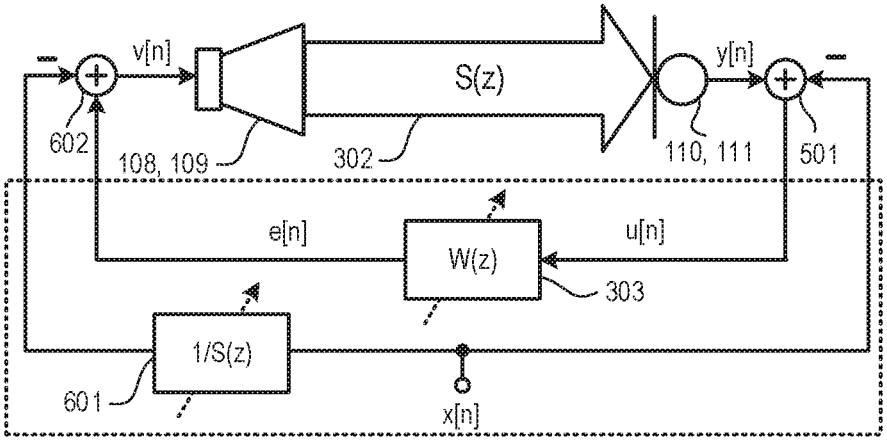
FIG. 6 is a signal flow chart of the active noise reduction system of FIG. 5, in which the useful signal is supplied via a spectrum shaping filter to the loudspeaker path.

In FIG. 6, a system is shown that is based on the system of FIG. 5 and that additionally includes an equalizing filter 601 connected upstream of the subtractor 602 in order to filter the useful signal x[n] with the inverse secondary path transfer function 1/S(z) or an approximation of the transfer function 1/S(z). The differential equations describing the system illustrated in FIG. 6 in view of the useful signal are as follows:

$$Y(z)=S(z)\cdot V(z)=S(z)\cdot(E(z)-X(z)/S(z)) \tag{20}$$

$$E(z)=W(z)\cdot U(z)=W(z)\cdot(Y(z)-X(z)) \tag{21}$$

The useful signal transfer characteristic M(z) in the system of FIG. 6 is thus $$M(z)=(1-W(z)\cdot S(z))/(1-W(z)\cdot S(z))=1 \tag{22}$$

As can be seen from equation (22), the microphone output signal y[n] is identical to the useful signal x[n], which means that signal x[n] is not altered by the system if the equalizer filter is exact the inverse of the secondary path transfer characteristic S(z). The equalizer filter 601 may be a minimum-phase filter for optimum results, i.e., optimum approximation of its actual transfer characteristic to the inverse of the, ideally minimum phase, secondary path transfer characteristic S(z) and, thus y[n]=x[n]. This configuration acts as an ideal linearizer, i.e., it compensates for any deteriorations of the useful signal due to its transfer from the loudspeaker 108 or 109 to the microphone 110 or 111 representing the listener' s ear. It hence compensates for or linearizes the disturbing influence of the secondary path S(z) to the useful signal x[n] so that the useful signal arrives at the listener as provided by the source, without any negative effect due to acoustical properties of the sound-reproducing noise-reducing helmet, i.e., y[z]=x[z]. As such, with the help of such a linearizing filter it is possible to make a poorly designed sound-reproducing noise-reducing helmet sound like an acoustically perfectly adjusted, i.e., linear one.

Figure 7:
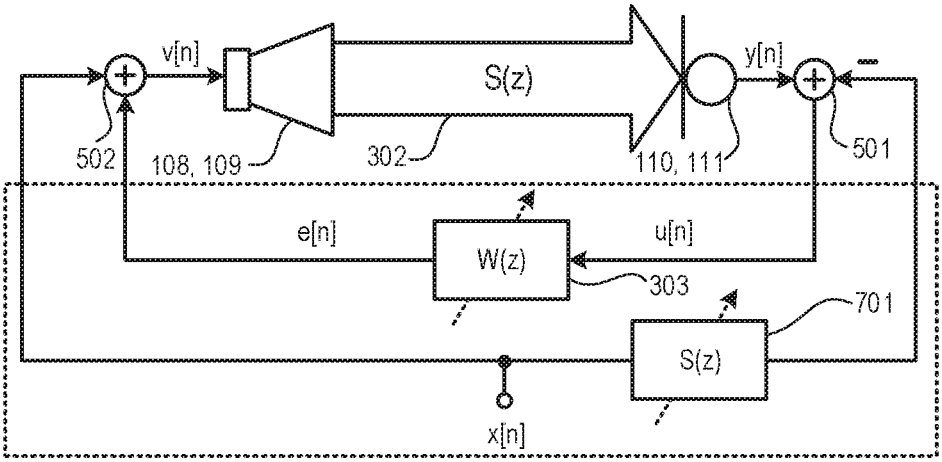
FIG. 7 is a signal flow chart of the active noise reduction system of FIG. 5, in which the useful signal is supplied via a spectrum shaping filter to the microphone path.

In FIG. 7, a system is shown that is based on the system of FIG. 5 and that additionally includes a secondary path modelling filter 701 connected upstream of the subtractor 501 in order to filter the useful signal x[n] with the secondary path transfer function S(z).

The differential equations describing the system illustrated in FIG. 7 in view of the useful signal are as follows:

$$Y(z)=S(z)\cdot V(z)=S(z)\cdot(E(z)+X(z)) \tag{23}$$

$$E(z)=W(z)\cdot U(z)=W(z)\cdot(Y(z)-S(z)\cdot X(z)) \tag{24}$$

The useful signal transfer characteristic M(z) in the system of FIG. 7 is thus $$M(z)=S(z)\cdot(1+W(z)\cdot S(z))/(1+W(z)\cdot S(z))=S(z) \tag{25}$$

From equation (25) it can be seen that the useful signal transfer characteristic M(z) is identical with the secondary path transfer characteristic S(z) when the ANC system is active. When the ANC system is not active, the useful signal transfer characteristic M(z) is also identical with the secondary path transfer characteristic S(z). Thus, the aural impression of the useful signal for a listener at a location close to the microphone 110 or 111 is the same regardless of whether noise reduction is active or not.

The ANC filter 303 and the filters 601 and 701 may be fixed filters with constant transfer characteristics or adaptive filters with controllable transfer characteristics. In the drawings, the adaptive structure of a filter per se is indicated by an arrow underlying the respective block and the optionality of the adaptive structure is indicated by a broken line.

The system shown in FIG. 7 is, for example, applicable in sound-reproducing noise-reducing helmets in which useful signals, such as music or speech, are reproduced under different conditions in terms of noise and the listener may appreciate being able to switch off the ANC system, in particular when no noise is present, without experiencing any audible difference be-tween the active and non-active state of the ANC system. However, the systems presented herein are not applicable in sound-reproducing noise-reducing helmets only, but also in all other fields in which occasional noise reduction is desired.

Figure 8:
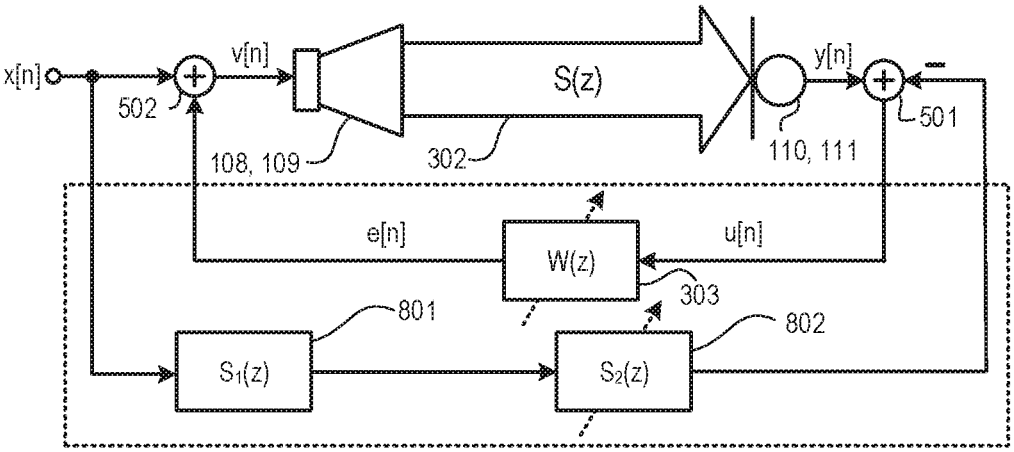
FIG. 8 is a signal flow chart of the active noise reduction system of FIG. 7 in which the useful signal is supplied via two spectrum shaping filters to the microphone path.

FIG. 8 shows an exemplary ANC module that employs (at least) two filters 801 and 802 (sub-filters) instead of the single filter 701 as in the system of FIG. 7. For instance, a treble cut shelving filter (e.g., filter 801) having a transfer characteristic S1(*z*) and a treble cut equalizing filter (e.g., filter 802) having a transfer characteristic S2(*z*), in which S(z)=S1(*z*)·S2(*z*). Alternatively, a treble boost equalizing filter may be implemented as, for example, filter 801 and/or a treble cut equalizing filter as, for example, filter 802. If the useful signal transfer characteristic M(z) exhibits an even more complex structure, three filters may be employed, for example, one treble cut shelving filter and one treble boost/cut filter and one equalizing filter. The number of filters used may depend on many other aspects such as costs, noise behavior of the filters, acoustic properties of the sound-reproducing noise-reducing helmet, delay time of the system, space available for implementing the system, etc.

Figure 9:
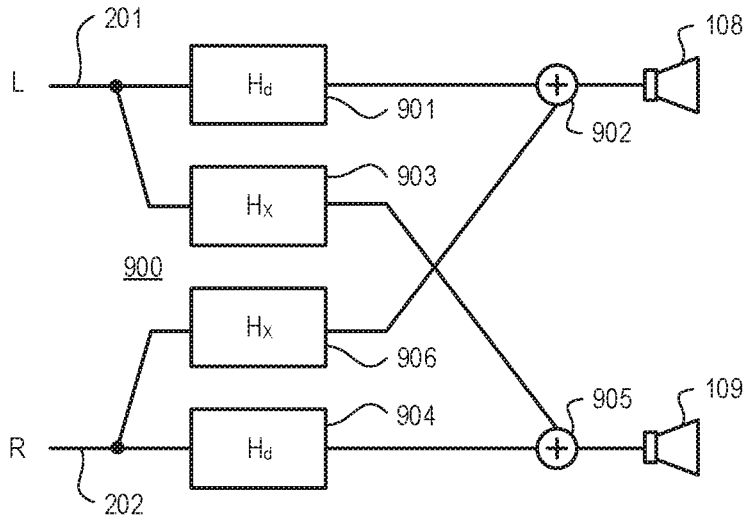
FIG. 9 is a signal flow chart illustrating a general structure of a stereo widening with direct paths and cross paths.

Referring to FIG. 9, the audio signal enhancer (sub-) module 204 shown in FIG. 1 may include a stereo widening function. The music that has been recorded over the last four decades is almost exclusively made in the two-channel stereo format which consists of two independent tracks, one for a left channel L and another for a right channel R. The two tracks are intended for playback over two loudspeakers, and they are mixed to provide a desired more realistic impression to a listener wearing the helmet. A more realistic sound impression includes that the sound experienced by the listener is identical or near identical to the sound provided by the sound source, which means that the audio path between audio source and the listener's ear exhibits (almost) no deteriorating effect.

In many situations, it is advantageous to be able to modify the inputs to the two loudspeakers in such a way that the listener perceives the sound stage as extending beyond the positions of the loudspeakers at both sides. This is particularly useful when a listener wants to play back a stereo recording over two loudspeakers that are positioned quite close to each other. A stereo widening processing scheme generally works by introducing cross-talk from the left input to the right loudspeaker, and from the right input to the left loudspeaker. The audio signal transmitted along direct paths from the left input to the left loudspeaker and from the right input to the right loudspeaker are usually also modified before being output from the left and right loudspeakers.

For example, sum-difference processors can be used as a stereo widening processing scheme mainly by boosting a part of the difference signal, L minus R, in order to make the extreme left and right part of the sound stage appear more prominent. Consequently, sum-difference processors do not provide high spatial fidelity since they tend to weaken the center image considerably. They are very easy to implement, however, since they do not rely on accurate frequency selectivity. Some simple sum-difference processors can even be implemented with analogue electronics without the need for digital signal processing.

Another type of stereo widening processing scheme is an inversion-based implementation, which generally comes in two disguises: cross-talk cancellation networks and virtual source imaging systems. A good cross-talk cancellation system can make a listener hear sound in one ear while there is silence at the other ear whereas a good virtual source imaging system can make a listener hear a sound coming from a position somewhere in space at a certain distance away from the listener. Both types of systems essentially work by reproducing the right sound pressures at the listener's ears, and in order to be able to control the sound pressures at the listener's ears it is necessary to know the effect of the presence of a human listener on the incoming sound waves. For example, inversion-based implementations may be designed as a simple cross-talk cancellation network based on a free-field model in which there are no appreciable effects on sound propagation from obstacles, boundaries, or reflecting surfaces. Other implementations may use sophisticated digital filter design methods that can also compensate for the influence of the listener's head, torso and pinna (outer ear) on the incoming sound waves.

As an alternative to the rigorous filter design techniques that are usually required for an inversion-based implementation, a suitable set of filters from experiments and empirical knowledge may be employed. This implementation is therefore based on tables whose contents are the result of listening tests. The stereo widening functionality is described above in connection with loudspeakers disposed in a room but is applied in the following to loudspeakers mounted in a helmet.

FIG. 9 shows in block form an exemplary structure of a stereo widening network 900 which comprises left and right loudspeakers, for example, loudspeakers 108 and 109 mounted in the helmet 100 shown in FIGS. 1 and 2. The (analog or digital) audio source 203 has separate audio channels L and R for left and right, respectively, which transmit audio signals 201 and 202. For example, the audio signal source may provide a digital audio stream in any format (e.g., MP3) and provided by any media (e.g., CD). The audio signal 201 (left channel L) is filtered by a filter 901 with a transfer function Hd, is added at an adder 902 to the audio signal 202 (right channel R) that is filtered by a filter 906 with a transfer function Hx, and is output to loudspeaker 108. Similarly, the audio signal 202 (right channel R) is filtered by a filter 904 with the transfer function Hd, is added at an adder 905 to the audio signal 201 (left channel L) that is filtered by a filter 903 with the transfer function Hx, and is output to loudspeaker 109.

The choice of the transfer functions Hd and Hx is motivated by the need for achieving a good spatial effect without degrading the quality of the original audio source material. In the present example, the transfer function Hd, used for both filters 901, 904, is a filter with a flat magnitude response, thus leaving the magnitude of the signal input thereto unchanged while introducing a group delay (it should be noted that group delays, and delays can vary as a function of frequency). Thus, significantly, transfer function Hd permits the respective channel from audio signal source 203 to pass through on a direct path to that channel's respective loudspeaker 108, 109 without any change in magnitude. The transfer function Hx, used for both filters 903, 906, is a filter whose magnitude response is substantially zero at and above a frequency of approximately 2 kHz, and whose magnitude response is not greater than that of transfer function Hd at any frequency below approximately 2 kHz. In addition, a group delay is introduced by filters 903 and 906 (each having transfer function Hx) that is generally greater than the group delay introduced by filters 901 and 904 (each having transfer function Hd).

Figure 10:
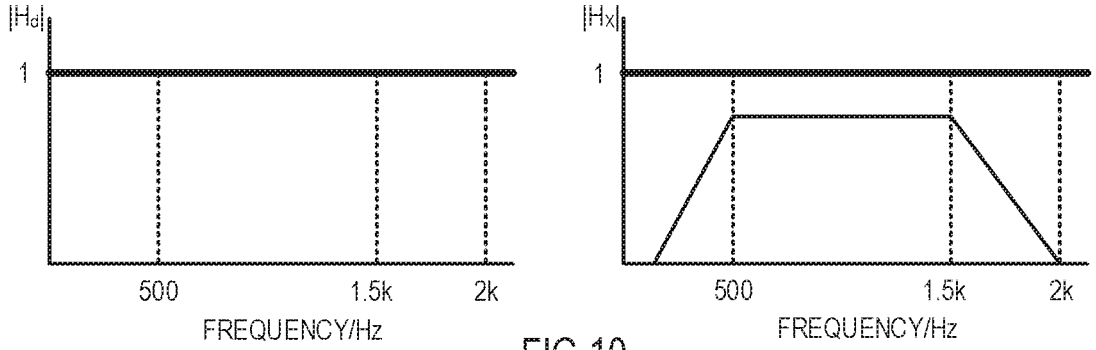
FIG. 10 shows a magnitude frequency diagram illustrating an example of an appropriate response characteristics of a filter in the direct paths, and a magnitude frequency diagram illustrating an example of an appropriate response characteristics of a filter in the cross paths.

FIG. 10 shows examples of appropriate magnitude responses of Hd and Hx, respectively. The magnitude response of transfer function Hx is bounded in the vertical direction by the magnitude of transfer function Hd, and in the horizontal direction by approximately 2 kHz. The magnitude of frequencies above approximately 2 kHz are designed not to be affected by transfer function Hx because altering the magnitude of these frequencies above approximately 2 kHz creates undesirable spectral coloration.

Additionally or alternatively, the audio signal enhancer (sub-) module 204 shown in FIG. 1 may include a functionality that restores data compressed audio signals, i.e., enhances data compressed audio signals. Data compressed audio signals are signals containing audio content, which have undergone some form of data compression, such as by a perceptual audio codec. Common types of perceptual audio codecs include MP3, AAC, Dolby Digital, and DTS. These perceptual audio codecs reduce the size of an audio signal by discarding a significant portion of the audio signal. Perceptual audio codecs can be used to reduce the amount of space (memory) required to store an audio signal, or to reduce the amount of bandwidth required to transmit or transfer audio signals. It is not uncommon to compress an audio signal by 90% or more. Perceptual audio codecs can employ a model of how the human auditory system perceives sounds. In this way a perceptual audio codec can discard those portions of the audio signal which are deemed to be either inaudible or least relevant to perception of the sound by a listener. As a result, perceptual audio codecs are able to reduce the size of an audio signal while still maintaining relatively good perceived audio quality with the remaining signal. In general, the perceived quality of a data compressed audio signal can be dependent on the bitrate of the data compressed signal. Lower bitrates can indicate that a larger portion of the original audio signal was discarded and therefore, in general, the perceived quality of the data compressed audio signal can be poorer.

There are numerous types of perceptual audio codecs and each type can use a different set of criteria in determining which portions of the original audio signal will be discarded in the compression process. Perceptual audio codecs can include an encoding and decoding process. The encoder receives the original audio signal and can determine which portions of the signal will be discarded. The encoder can then place the remaining signal in a format that is suitable for data compressed storage and/or transmission. The decoder can receive the data compressed audio signal, decode it, and can then convert the decoded audio signal to a format that is suitable for audio playback. In most perceptual audio codecs the encoding process, which can include use of a perceptual model, can determine the resulting quality of the data compressed audio signal. In these cases the decoder can serve as a format converter that converts the signal from the data compressed format (usually some form of frequency-domain representation) to a format suitable for audio playback.

An audio signal enhancer module can modify a data compressed audio signal that has been processed by a perceptual audio codec such that signal components and characteristics which may have been discarded or altered in the compression process are perceived to be restored in the processed output signal. As used herein, the term audio signal may refer to either an electrical signal representative of audio content, or an audible sound, unless described otherwise.

When audio signals are data compressed using a perceptual audio codec it is impossible to retrieve the discarded signal components. However, an audio signal enhancer module can analyze the remaining signal components in a data compressed audio signal, and generate new signal components to perceptually replace the discarded components.

Figure 11:
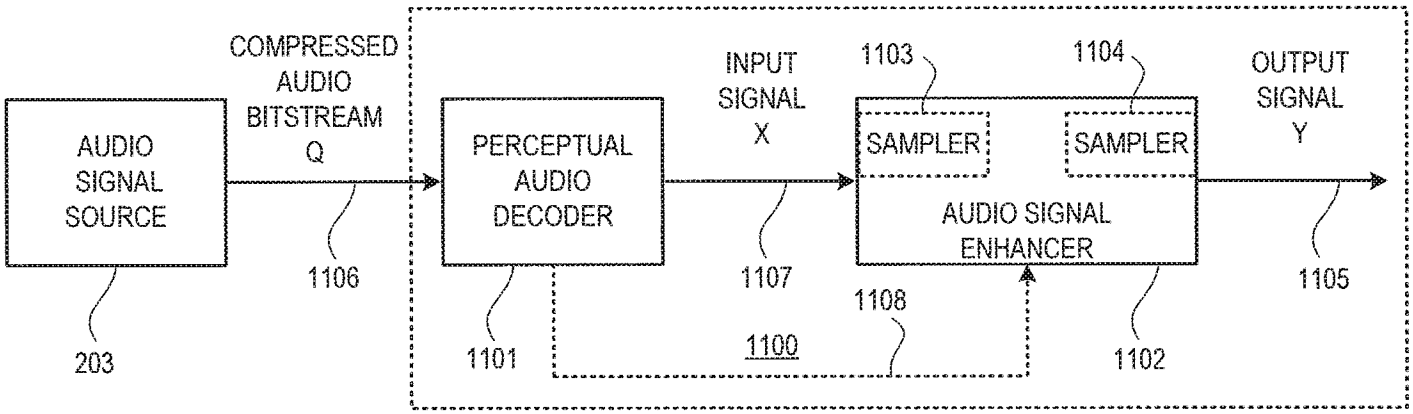
FIG. 11 is a signal flow chart that includes an example signal enhancer used in conjunction with a perceptual audio encoder and decoder.

FIG. 11 is a signal flow chart that includes an example of an audio signal enhancer module 1100 which may be used as, in or in connection with audio signal enhancer (sub-) module 204. The audio signal enhancer module 1100 includes a perceptual audio signal decoder 1101 and an audio signal enhancer 1102 and can operate in the frequency domain or the time domain. The audio signal enhancer 1102 may include a sampler 1103 (including a domain converter) which may receive an input signal X in real time, and divide the input signal X into samples. During operation in the frequency domain, the sampler 1103 may collect sequential time-domain samples, a suitable windowing function is applied (such as the root-Hann window), and the windowed samples are converted to sequential bins in the frequency domain, such as using a FFT (Fast Fourier Transform). Similarly, in the audio signal enhancer 1102, the enhanced frequency-domain bins can be converted by a sampler 1104 (including a domain converter) to the time domain using an inverse-FFT (inverse Fast Fourier Transform), and a suitable complementary window is applied (such as a root-Hann window), to produce a block of enhanced time-domain samples. Short-term spectral analysis, for example, by employing an overlap-add or an overlap-save may provide an overlap of a predetermined amount, such as at least 50%. Alternatively, the audio signal enhancer 1102 can operate in the time domain using the sequential blocks of time domain samples, and the domain converters may be eliminated from the samplers 1103 and 1104. In order to simplify the discussion and figures, further discussion and illustration of the samplers 1103 and 1104 as well as time-to-frequency and frequency-to-time conversion is omitted. Thus, as described herein, sequential samples or a sequence of samples may interchangeably refer to a time series sequence of time domain samples, or a time series sequence of frequency domain bins corresponding to time series receipt of input signal X that has been sampled by the sampler 1103.

In FIG. 11, the audio signal enhancer 1102 is illustrated as being used in conjunction with the perceptual audio signal decoder 1101. A data compressed audio bitstream Q is supplied by the audio signal source 203 to the perceptual audio signal decoder 1101 on a data compressed bitstream line 1106. The perceptual audio decoder 1101 may decode the data compressed audio bitstream Q to produce input signal X on an input signal line 1107. The input signal X may be an audio signal in a format suitable for audio playback. The audio signal enhancer 1102 may operate to divide the input signal X into a sequence of samples in order to enhance the input signal X to produce an output signal Y on output signal line 1105. Side-chain data may contain information related to processing of the input signal X such as indication of: the type of audio codec used, the codec manufacturer, the bitrate, stereo versus joint-stereo encoding, the sampling rate, the number of unique input channels, the coding block size, and a song/track identifier. In other examples, any other information related to the audio signal X or the encoding/decoding process may be included as part of the side chain data. The side chain data may be provided to the audio signal enhancer 1102 from the perceptual audio decoder 1101 on a side chain data line 1108. Alternatively, or in addition, the side chain data may be included as part of the input signal X.

Figure 12:
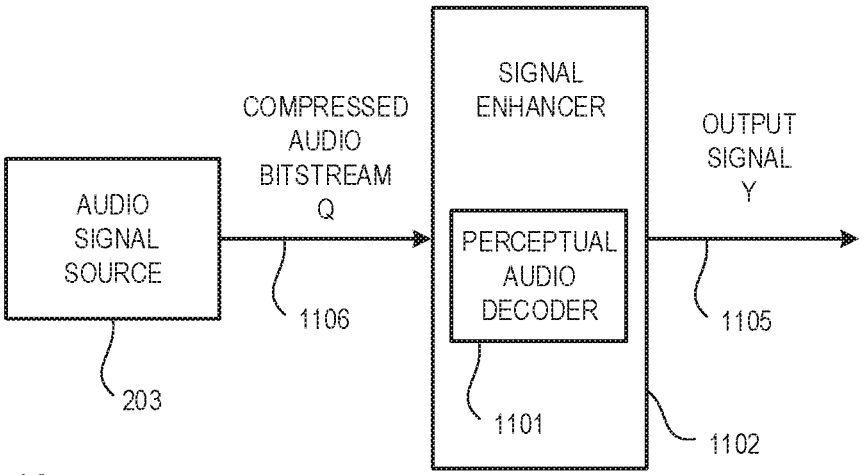
FIG. 12 is a signal flow chart that includes an example of a perceptual audio decoder integrated into the signal enhancer.

FIG. 12 is a signal flow chart of an example of the audio signal enhancer 1102 in which the perceptual audio decoder 1101 can be incorporated as part of the audio signal enhancer 1102. As a result, the audio signal enhancer 1102 may operate directly on the data compressed audio bitstream Q received on the data compressed bitstream line 1106. Alternatively, in other examples, the audio signal enhancer 1102 may be included in the perceptual audio decoder 1101. In this configuration the audio signal enhancer 1102 may have access to the details of data compressed audio bitstream Q on line 1106.

Figure 13:
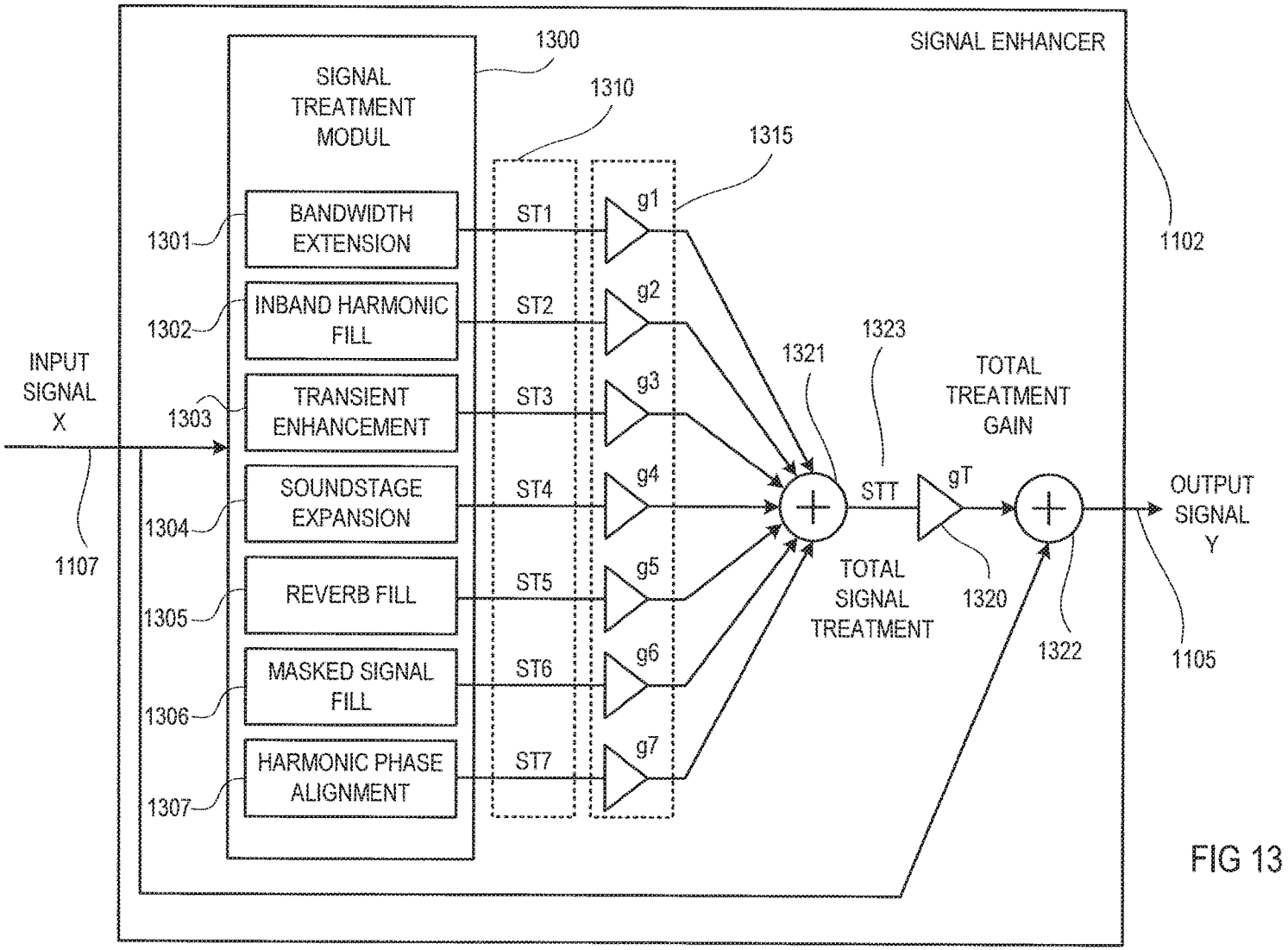
FIG. 13 is a signal flow chart of an example of the signal enhancer system.

FIG. 13 is a signal flow chart of an example of the audio signal enhancer 1102. In FIG. 13, the audio signal enhancer 1102 includes a signal treatment module 1300 that may receive the input signal X on the input signal line 1107. The signal treatment module 1300 may produce a number of individual and unique signal treatments ST1, ST2, ST3, ST4, ST5, ST6, and ST7 on corresponding signal treatment lines 1310. Although seven signal treatments are illustrated, fewer or greater numbers n of signal treatments are possible in other examples. The relative energy levels of each of the signal treatments STn may be individually adjusted by the treatment gains g1, g2, g3, g4, g5, g6, and g7 in a gain stage 1315 prior to being added together at a first summing block 1321 to produce a total signal treatment STT on line 1323. The level of the total signal treatment STT on line 1323 may be adjusted by the total treatment gain gT on line 1320 prior to being added to the input signal X on line 1107 at a second summing block 1322.

The signal treatment module 1300 may include one or more treatment modules 1301, 1302, 1303, 1304, 1305, 1306, and 1307, which operate on individual sample components of sequential samples of the input signal X to produce the signal treatments 1310 sequentially on a sample-by-sample basis for each of the respective components. The individual sample component of the sequential samples may relate to different characteristics of the audio signal. Alternatively, or in addition, the signal treatment module 1300 may include additional or fewer treatment modules 1300. The illustrated modules may be independent, or may be sub modules that are formed in any of various combinations to create modules.

Another effect encountered when trying to reproduce sounds from a plurality of sound sources is the inability of an audio system to recreate what is referred to as sound staging. Sound staging is the phenomenon that enables a listener to perceive the apparent physical size and location of a musical presentation. The sound stage includes the physical properties of depth and width. These properties contribute to the ability to listen to an orchestra, for example, and be able to discern the relative position of different sound sources (e.g., instruments). However, many recording systems fail to precisely capture the sound staging effect when recording a plurality of sound sources. One reason for this is the methodology used by many systems. For example, such systems typically use one or more microphones to receive sound waves produced by a plurality of sound sources and convert the sound waves to electrical audio signals. When one microphone is used, the sound waves from each of the sound sources are typically mixed (i.e., superimposed on one another) to form a composite signal. When a plurality of microphones are used, the plurality of audio signals are typically mixed (i.e., superimposed on one another) to form a composite signal. In either case the composite signal is then stored on a storage medium. The composite signal can be subsequently read from the storage medium and reproduced in an attempt to recreate the original sounds produced by the sound sources. However, the mixing of signals, among other things, limits the ability to recreate the sound staging of the plurality of sound sources. Thus, when signals are mixed, the reproduced sound fails to precisely recreate the original sounds. This is one reason why an orchestra sounds different when listened to live as compared with a recording.

For example, in some cases, the composite signal includes two separate channels (e.g., left and right) in an attempt to spatially separate the composite signal. In some cases, a third (e.g., center) or more channels (e.g., front and back) are used to achieve greater spatial separation of the original sounds produced by the plurality of sound sources. However, regardless of the number of channels, such systems typically involve mixing audio signals to form one or more composite signals. Even systems touted as "discrete multichannel", base the discreteness of each channel on a "directional component". "Directional components" help create a more engulfing acoustical effect, but do not address the critical losses of veracity within the audio signal itself. Other separation techniques are commonly used in an attempt to enhance the recreation of sound. For example, each loudspeaker typically includes a plurality of loudspeaker components, with each component dedicated to a particular frequency band to achieve a frequency distribution of the reproduced sounds. Commonly, such loudspeaker components include woofer or bass (lower frequencies), mid-range (moderate frequencies) and tweeters (higher frequencies). Components directed to other specific frequency bands are also known and may be used. When frequency distributed components are used for each of multiple channels (e.g., left and right), the output signal can exhibit a degree of both spatial and frequency distribution in an attempt to reproduce the sounds produced by the plurality of sound sources.

Another problem resulting from the mixing of either sounds produced by sound sources or the corresponding audio signals is that this mixing typically requires that these composite sounds or composite audio signals be played back over the same loudspeaker(s). It is well known that effects such as masking preclude the precise recreation of the original sounds. For example, masking can render one sound inaudible when accompanied by a louder sound. For example, the inability to hear a conversation in the presence of loud amplified music is an example of masking. Masking is particularly problematic when-the masking sound has a similar frequency to the masked sound. Other types of masking include loudspeaker masking, which occurs when a loudspeaker cone is driven by a composite signal as opposed to an audio signal corresponding to a single sound source. Thus, in the later case, the loudspeaker cone directs all of its energy to reproducing one isolated sound, whereas, in the former case, the loudspeaker cone must "time-share" its energy to reproduce a composite of sounds simultaneously.

Figure 14:
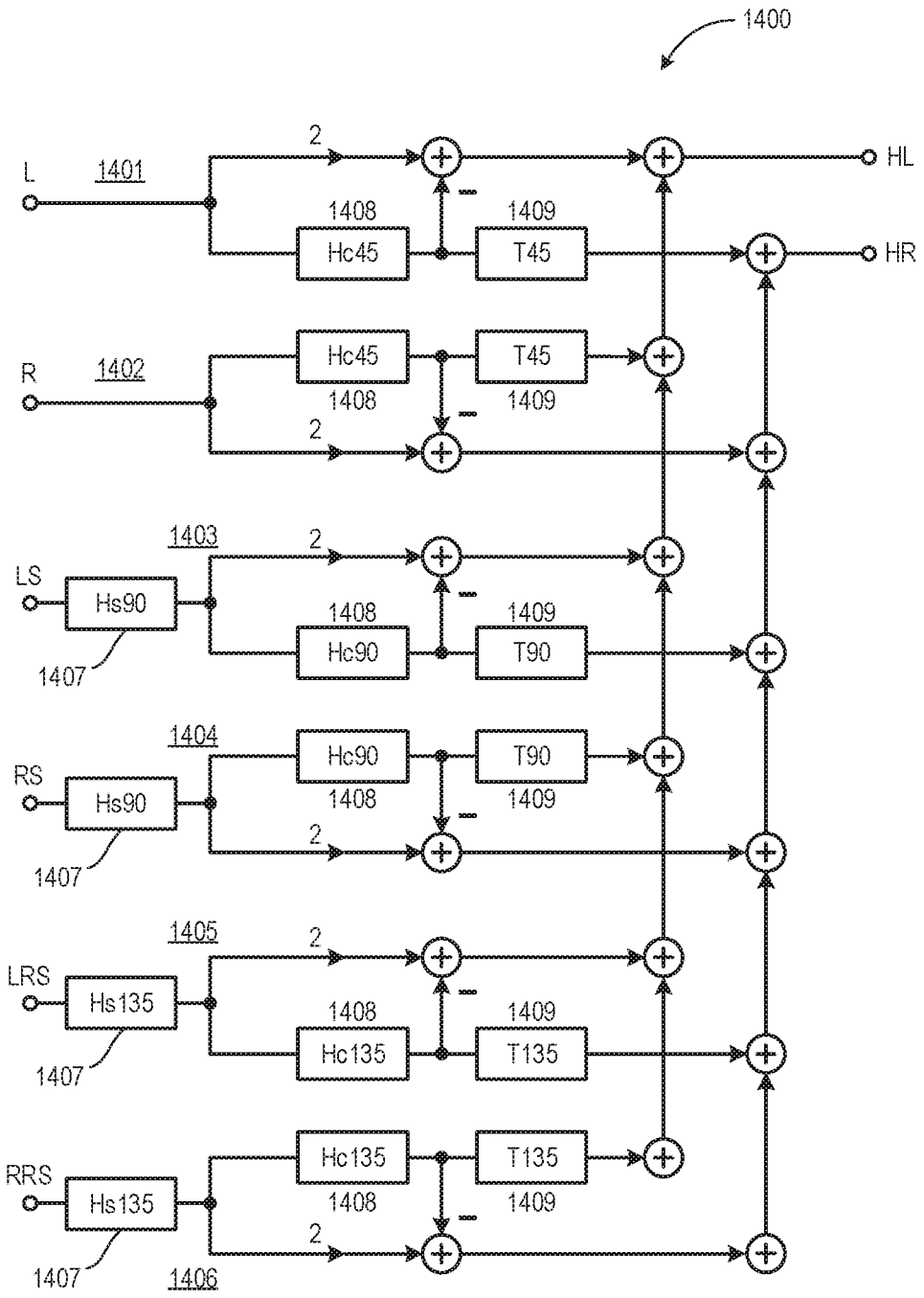
FIG. 14 is a signal flow chart of an example of a multi-channel sound staging module.

FIG. 14 is a signal flow chart that depicts an example a multi-input audio enhancement (sub-) module 1400 with sound staging functionality and a multiplicity of input channels with audio input signals L, R, LS, RS LRS and RRS. (sub-) module 1400, which may be used as, in or in connection with audio enhancement (sub-) module 204, includes six blocks 1401 to 1406. The basic structure of blocks 1401 to 1406 includes sum filters 1407 and cross filters 1408 for transforming an audio signal, which is inputted as input signal L, R, LS, RS LRS or RRS, into direct and indirect head-related transfer functions (HRTFs) that are outputted at respective filter outputs. The outputs of the cross filters 1408 are subtracted from the outputs of the sum filters 1407 to provide first block output signals. Other block output signals are generated by delaying the output signals of the cross filters 1408 by way of interaural delays 1409. The example blocks 1401 to 1406 perform the function of transforming an audio input signal to direct and indirect HRTFs. Additionally, the output signal from the sum filter 1407 may be multiplied, for example, by a factor of 2, before the cross filter output is subtracted from the product of the multiplication. This results in the direct HRTF. The signal outputted by the cross filter represents the indirect HRTF.

Regarding the sum filters 1407, when applied to audio signals they can provide spectral modifications so that such qualities of the signals are substantially similar for both ears of a listener. Sum filters 1407 can also eliminate undesired resonances and/or undesired peaking possibly included in the frequency response of the audio signals. As for the cross filters 1408, when applied to the audio signals they provide spectral modifications so that the signals are acoustically perceived by a listener as coming from a predetermined direction or location. This functionality is achieved by adjustment of head shadowing. In both cases, it may be desired that such modifications are unique to an individual listener's specific characteristics. To accommodate such a desire, both the sum filters 1407 and cross filters 1408 are designed so that the frequency responses of the filtered audio signals are less sensitive to listener specific characteristics. In blocks 1401 and 1402, the sum filters have a transfer function of "1" so that the sum filters can be substituted by a direct connection. As already mentioned, the blocks 1401 to 1406 further include interaural delays 1409 for source angles of 45, 90, and 135 degrees (labeled "T45", "T90", and "T135", respectively). The delay filters 1409 can have typical samplings of 17 samples, 34 samples, and 21 samples, respectively, at a sample rate of 48 kHz. The delay filters 1409 simulate the time a sound wave takes to reach one ear after it first reaches the other ear.

The other components of the module 1400 can transform audio signals from one or more sources into a binaural format, such as direct and indirect HRTFs. Specifically, audio enhancement (sub-) module 1400 transforms audio signals from a 6-channel surround sound system by direct and indirect HRTFs into output signals HL and HR outputted by right and left loudspeakers in a helmet (not shown). These signals outputted by the loudspeakers in the helmet will include the typically perceived enhancements of 6-channel surround sound without unwanted artifacts. Also with respect to each output of the loudspeakers in the helmet respective sets of summations are included to sum three input pairs of 6-channel surround sound. The six audio signal inputs include left, right, left surround, right surround, left rear surround, and right rear surround (labeled "L", "R", "LS", "RS", "LRS", and "RRS", respectively). Also depicted by FIG. 14 are sum and cross filters for source angles of 45, 90, and 135 degrees (labeled "Hc90", "Hc135", "Hc45", "Hc90", and "Hc135", respectively). As noted above, sum filters are absent from the transformation of the audio signals coming from sources that have a 45 degree source angle. Alternatively, sum filters equaling a constant 1 value could be added to the implementation depicted in FIG. 14 and similar outputs would occur at the outputs HL and HR. Also, alternatively, implementations could employ other filters for sources that have other source angles, such as 30, 80, and 145 degrees. Further, some implementations may store, for example, in a memory, various sum and cross filter coefficients for different source angles, so that such filters are selectable by end users. In such implementations, listeners can adjust the angles and simulated locations from which they perceive sound. Alternatively, instead of sound staging any (other) spatial audio processing, for example, two-dimensional audio and three-dimensional audio, is applicable as well.

The description of embodiments has been presented for purposes of illustration and description. Suitable modifications and variations to the embodiments may be performed in light of the above description. The described systems are exemplary in nature, and may include additional elements and/or omit elements. As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. A signal flow chart may describe a system, method or software implementing the method dependent on the type of realization. e.g., as hardware, software or a combination thereof.

What is claimed is:

1. A sound reproducing, noise reducing system comprising:

a helmet comprising an outer shell;

two loudspeakers disposed in the helmet at opposing positions from one another;

two microphones disposed at positions in a vicinity of the two loudspeakers;

two active noise control modules coupled to the two loudspeakers, the active noise control modules being configured to supply to a corresponding loudspeaker a useful signal that represents sound to be reproduced and an anti-noise signal that, when reproduced by the corresponding loudspeaker, reduces noise in the vicinity of the corresponding loudspeaker; and an audio signal enhancement module connected upstream of the active noise control modules, the audio signal enhancement module being configured to receive audio input signals and to process the audio input signals to provide the useful signals with at least one of a stereo widening functionality, a sound stage functionality, two-dimensional-audio, and three-dimensional audio, wherein the loudspeakers are disposed in ear-cups, and wherein a first active noise control module of the two active noise control modules includes:

a first filter configured to filter the useful signal; and a second filter, positioned in series with the first filter, to filter an output of the first filter to generate a series filter output signal; and a first adder configured to add a first microphone signal provided by a microphone to the series filter output signal to provide a filter input signal to an active noise control filter that generates an error signal in response to the filter input signal.

2. The system of claim 1, wherein the audio signal enhancement module is further configured to provide a more spatial sound expression to a listener than the audio input signals.

3. The system of claim 2, wherein the audio signal enhancement module is further configured to provide at least one of two-dimensional audio and three-dimensional audio.

4. The system of claim 1, wherein the audio input signals are data compressed signals and the audio signal enhancement module is further configured to restore signal components lost during compression.

5. The system of claim 1, wherein each active noise control module is configured to:

supply the corresponding useful signal to the corresponding loudspeaker to radiate the sound to be reproduced;

receive a microphone output signal representing sound picked up by the corresponding microphone;

subtract the microphone output signal from the useful signal to generate a filter input signal;

filter the filter input signal with an active noise reduction filter to generate an error signal; and add the useful signal and the error signal to generate the anti-noise signal supplied to the loudspeaker.

6. The system of claim 5, wherein each active noise control module is further configured to filter the useful signal with one or more spectrum shaping filters prior to subtraction of the useful signal from at least one of the microphone output signal and the error signal.

7. The system of claim 6, wherein the two microphones are acoustically coupled to the loudspeakers via a secondary paths, the secondary path having a secondary path transfer characteristic; and the one or more spectrum shaping filters being configured to model in combination the secondary path transfer characteristic.

8. The system of claim 7, wherein the useful signal, prior to subtraction from the microphone output signal, is filtered with a transfer characteristic that models the secondary path transfer characteristic.

9. The system of claim 1, wherein the first adder subtracts the series filter output signal from the microphone output signal to provide the filter input signal to the active noise control filter.

10. A sound reproducing, noise reducing method comprising:

supplying to a corresponding loudspeaker in a helmet, a useful signal that represents sound to be reproduced and an anti-noise signal that, when reproduced by the corresponding loudspeaker, reduces noise in a vicinity of the corresponding loudspeaker, wherein the loudspeaker is disposed in an ear-cup of a helmet, the helmet comprising an outer shell;

receiving and processing audio input signals to provide the useful signals with at least one of a stereo widening functionality, a sound staging functionality, two-dimensional-audio, and three-dimensional audio; and filtering, via a first filter, the useful signal;

filtering, via a second filter positioned in series with the first filter, an output of the first filter to generate a series filter output signal; and adding, via a first adder, a first microphone signal provided by a microphone to the series filter output signal to provide a filter input signal to an active noise control filter that generates an error signal in response to the filter input signal.

11. The method of claim 10, further comprising providing, via an audio signal enhancement module, a spatial sound expression to a listener than the audio input signals.

12. The method of claim 10, further comprising:

supplying the corresponding useful signal to the corresponding loudspeaker to radiate the sound to be reproduced;

receiving a microphone output signal representing the sound picked up by the corresponding microphone;

subtracting the microphone output signal from the useful signal to generate a filter input signal;

filtering the filter input signal with an active noise reduction filter to generate an error signal; and adding the useful signal and the error signal to generate the anti-noise signal supplied to the loudspeaker.

13. The method of claim 12, further comprising filtering the useful signal by one or more spectrum shaping filters prior to subtraction of the useful signal from at least one of the microphone output signal and the error signal.

14. The method of claim 13, further comprising acoustically coupling two microphones positioned in the helmet to the loudspeakers via secondary paths, the secondary path having a second path transfer characteristic; and modeling in combination the second path transfer characteristic via the one or more spectrum shaping filters.

15. The method of claim 14, wherein the useful signal, prior to subtraction from the microphone output signal, is filtered with a transfer characteristic that models a secondary path transfer characteristic.

16. A sound reproducing, noise reducing system comprising:

a helmet comprising an outer shell;

two loudspeakers disposed in the helmet at opposing positions from one another;

two microphones disposed at a position in a vicinity of the two loudspeakers;

two active noise control modules coupled to the two loudspeakers, each active noise control modules being configured to supply to a corresponding loudspeaker a useful signal indicative of a sound to be reproduced and an anti-noise signal that, when reproduced by the corresponding loudspeaker, reduces noise in the vicinity of the corresponding loudspeaker; and an audio signal enhancement module being operatively coupled to the two active noise control modules, the audio signal enhancement module being configured to process audio input signals to provide the useful signals with at least one of a stereo widening functionality, a sound stage functionality, two-dimensional-audio, and three-dimensional audio, wherein the loudspeakers are disposed in ear-cups, and wherein a first active noise control module of the two active noise control modules includes:

a first filter configured to filter the useful signal; and a second filter, positioned in series with the first filter, to filter an output of the first filter to generate a series filter output signal; and a first adder configured to add a first microphone signal provided by a microphone to the series filter output signal to provide a filter input signal to an active noise control filter that generates an error signal in response to the filter input signal.

17. The system of claim 16, wherein the audio signal enhancement module is further configured to provide a more spatial sound expression to a listener than the audio input signals.

18. The system of claim 17, wherein the audio signal enhancement module is further configured to provide at least one of two-dimensional audio and three-dimensional audio.

19. The system of claim 16, wherein the audio input signals are data compressed signals and the audio signal enhancement module is further configured to restore signal components lost during compression of the audio input signals.

* * * * *